US011787518B2

(12) United States Patent
Keesaer et al.

(10) Patent No.: US 11,787,518 B2
(45) Date of Patent: Oct. 17, 2023

(54) BACKBOARD INFLATABLE RESCUE DEVICE

(71) Applicant: Timothy E Schmitt, Greenville, IN (US)

(72) Inventors: John N Keesaer, Louisville, KY (US); Timothy E Schmitt, Greenville, IN (US); George R Kruer, III, Jeffersonville, IN (US); Donald R Burns, Louisville, KY (US)

(73) Assignee: Timothy Schmitt, Greenville, IN (US)

( * ) Notice: Subject to any disclaimer, the term of this patent is extended or adjusted under 35 U.S.C. 154(b) by 733 days.

(21) Appl. No.: 16/927,077

(22) Filed: Jul. 13, 2020

(65) Prior Publication Data

US 2021/0024186 A1 Jan. 28, 2021

Related U.S. Application Data

(60) Provisional application No. 62/878,417, filed on Jul. 25, 2019, provisional application No. 62/887,906, filed on Aug. 16, 2019.

(51) Int. Cl.

| | |
|---|---|
| ***B63C 9/08*** | (2006.01) |
| ***A61G 1/04*** | (2006.01) |
| ***A61G 1/013*** | (2006.01) |
| ***B63C 9/00*** | (2006.01) |
| ***A61G 1/00*** | (2006.01) |
| ***A61G 1/048*** | (2006.01) |
| ***B63C 9/18*** | (2006.01) |

(52) U.S. Cl.

CPC ..... *B63C 9/081* (2013.01); *A61G 1/00* (2013.01); *A61G 1/013* (2013.01); *A61G 1/04* (2013.01); *A61G 1/048* (2013.01); *B63C 9/00* (2013.01); *B63C 9/08* (2013.01); *B63C 9/082* (2013.01); *B63C 9/18* (2013.01)

(58) Field of Classification Search

CPC ..... B63C 9/00; B63C 9/04; B63C 2009/042; B63C 9/08; B63C 9/081; B63C 9/082; B63C 9/18; A61G 1/00; A61G 1/013; A61G 1/04; A61G 1/044; A61G 1/048

See application file for complete search history.

(56) References Cited

U.S. PATENT DOCUMENTS 1,220,876 A * 3/1917 Moore ..... B63B 59/02 114/360
2,519,376 A * 8/1950 Jennings ..... A61G 1/00 441/80

(Continued)

FOREIGN PATENT DOCUMENTS

DE 450647 C * 10/1927

*Primary Examiner* — Ajay Vasudeva
(74) *Attorney, Agent, or Firm* — Duncan Galloway Greenwald PLLC; Kevin T. Duncan

(57) ABSTRACT

An inflatable rescue attachment includes at least a U-shaped bladder that is adapted to be secured around the outer perimeter of the head and side portions of a rescue backboard and can be inflated rapidly using an inflation fluid source. The rigid, inflatable backboard includes a central portion with drop stitch material enclosed in an airtight chamber which, when inflated, provides a flat, rigid surface for securing and transporting a rescuee. The inflatable rescue attachment may be used with the inflatable backboard, as well as with a standard wood, plastic, or fiberglass rescue backboard.

14 Claims, 10 Drawing Sheets

(56) References Cited

U.S. PATENT DOCUMENTS

| | | | | | |
|---|---|---|---|---|---|
| 3,343,189 | A * | 9/1967 | Pollard | B63C 9/00 | 441/83 |
| 3,775,782 | A * | 12/1973 | Rice | A61G 1/00 | 128/DIG. 20 |
| 4,520,746 | A * | 6/1985 | Walters | B63B 43/14 | 114/69 |
| 4,621,382 | A * | 11/1986 | Burriss | B63C 9/08 | 5/628 |
| 6,138,306 | A | 10/2000 | Muhanna | | |
| 8,328,592 | B2 * | 12/2012 | Cynamon | A61G 1/01 | 441/40 |
| 10,154,930 | B2 | 12/2018 | Stryker | | |
| 2017/0312151 | A1 | 11/2017 | Schlösser et al. | | |

* cited by examiner

BACKBOARD INFLATABLE RESCUE DEVICE

This application claims priority from U.S. Provisional Application Ser. No. 62/878,417 filed Jul. 25, 2019, and from U.S. Provisional Application Ser. No. 62/887,906 filed Aug. 16, 2019, both of which are hereby incorporated herein by reference.

BACKGROUND

The present invention relates to a rescue backboard. In a first instance, it relates to an inflatable device which attaches to a rescue backboard to assist in water and various rescue operations. In a second instance, it relates to a rescue backboard which itself may be fully deflated for transportation and storage as a rolled up or folded, very compact package, but which may be inflated rapidly to a flat, rigid rescue backboard.

Prior art rescue backboards provide a rigid platform for placing, securing, and transporting the person to be rescued (hereinafter referred to as the rescuee). It may be necessary to provide and/or establish an airway for the rescuee during the rescue process, and it is very difficult to provide this during a water rescue unless several rescuers are assisting. It takes at least two people to keep the rescuee and the backboard afloat by treading water, another person to tow the rescuee to the shore, and yet another person or two to provide the chest compressions and to make sure a clear airway is provided so that the rescuee does not take in more water during the rescue operation.

Some prior art rescue backboards provide buoyancy by attaching foam material to the backboard. This foam material may degrade in storage, is bulky to store, may attract animals, such as mice, that feed on the foam material, further degrading the buoyant properties of the foam material. The foam material also provides increased drag when swimming out to the rescuee and makes it extremely difficult to slide the rescue backboard under the rescuee, because the buoyant foam material fights against the immersion of the backboard under water to slide it in under the rescuee.

A conventional rigid rescue backboard takes up a lot of storage space. Also, in many instances, it can be cumbersome to transport a conventional rigid rescue backboard to the site where it is needed. Examples in which a conventional rigid rescue backboard presents a problem includes a situation in which multiple rescue backboards are needed at an accident site, such as a mining accident, a plane wreck in a remote wilderness area, a high-rise building evacuation in the event of an earthquake, or even a multi-car accident on the freeway. There is a need for a rescue backboard which is lightweight, which may be stored and transported in a compact configuration so that many rescue backboards may be carried quickly and easily, even through cramped and narrow spaces, and which is fully functional and rigid in its deployed configuration. It also is desirable to be able to convert the rescue backboard quickly and easily from its compact storage configuration to its rigid deployed configuration. There are inflatable rescue devices in the prior art, but they are made similar to an air mattress and are not as rigid as the prior art rescue backboards. They are not rigid enough to allow a rescuer to perform chest compressions on the rescuee while the rescuee is on the rescue device.

SUMMARY

An embodiment described herein provides an inflatable attachment that is secured to at least a portion of the perimeter of a rescue backboard. The inflatable attachment may be inflated rapidly during the rescue, using a compressed liquified foam or another inflation fluid source, such as an air or $CO_2$ canister, after the backboard has been placed under the rescuee. The amount of fluid admitted into the inflatable attachment (or removed from it) may be adjusted "on the fly" to compensate for the weight of the rescuee. The users also may inflate the attachment manually in the event that the inflation fluid canister is insufficient to complete the task.

A universal kit is provided, including the inflatable attachment and inflation fluid source with quick release valve. This universal kit is made so it can be attached readily to a wide range of existing rescue backboards to convert the backboard to a much more useful rescue device.

Another embodiment described herein provides a rescue backboard which itself is inflatable. This inflatable rescue backboard may be rolled up or folded for compact transportation and storage and can be inflated quickly and easily to provide a support for the rescuee that is just as rigid as a wooden, fiberglass, or other standard, prior art rescue backboard. The inflatable rescue backboard may be inflated using a gas source, such as an air or $CO_2$ canister, a compressor, or even by a person blowing into it.

Of course, it also is possible to use the two embodiments together, securing the inflatable attachment to an inflatable rescue backboard instead of securing it to a prior art wooden or fiberglass backboard.

DESCRIPTION

Figure 1:
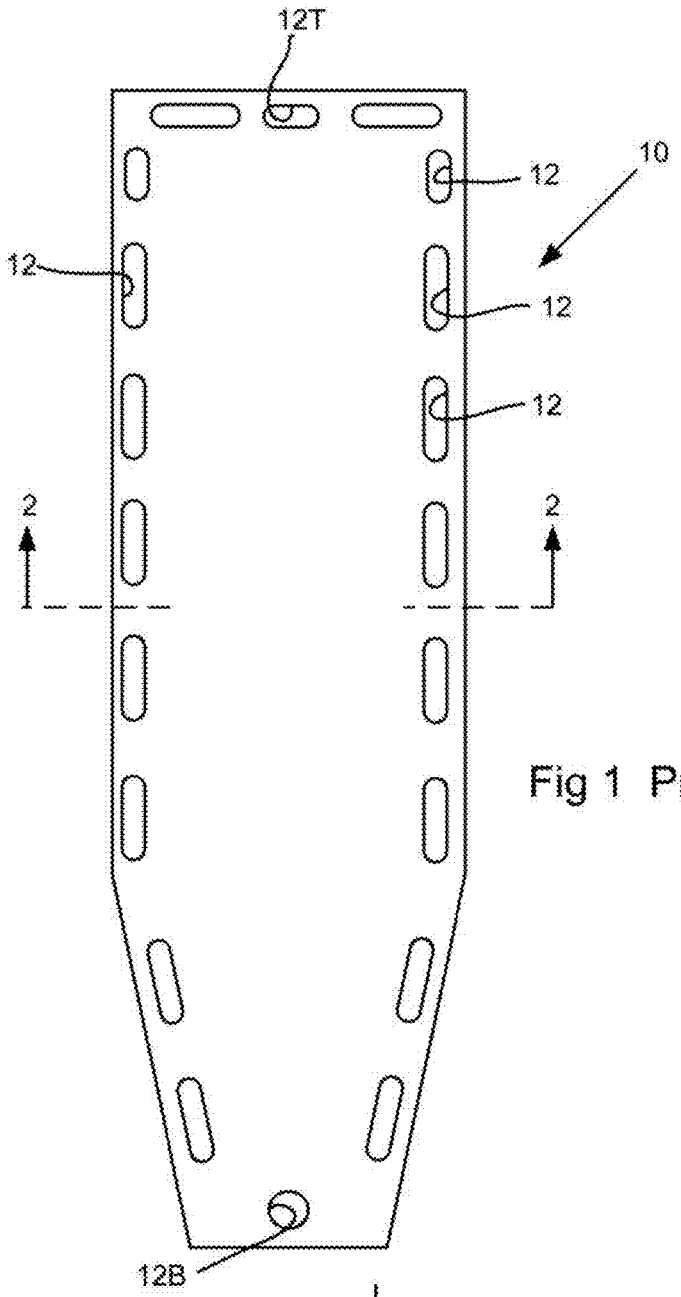
Fig 1 Prior Art
FIG. 1 is a plan view of a prior art rescue backboard.
Figure 1A:
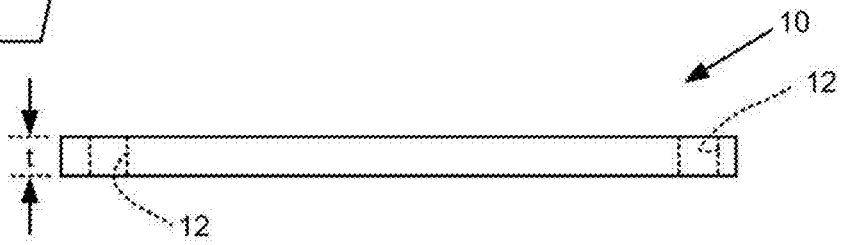
Fig 1A Prior Art
FIG. 1A is a section view taken along the section 2-2 of FIG. 1.

FIG. 1 shows a prior art rescue backboard 10. This rescue backboard 10 has a uniform thickness and is generally rectangular in shape, as generally shown in FIG. 1A, except that the portion that supports a person's legs tapers to a narrower width than the portion that supports a person's head and torso. The backboard 10 has several through openings 12 around its perimeter, which may be used as handles for the rescuer(s) to use for grabbing and carrying the backboard 10. One or more of these openings 12, such as the bottom opening 12B or the top opening 12T, may be used to secure a tow line (not shown) for towing the backboard 10. Some of the openings 12 also may be used to secure one or more straps (not shown), which may be used to secure the rescuee onto the backboard 10.

This rescue backboard 10 is rigid, has a uniform, relatively thin thickness, and usually is made out of wood, fiberglass, or a hard plastic so that it may function as a solid platform for immobilizing the spine of a rescuee during the rescue and for permitting rescuers to provide first aid, such as CPR, to the rescuee during the rescue, including while the rescuee is being transported.

Figure 2:
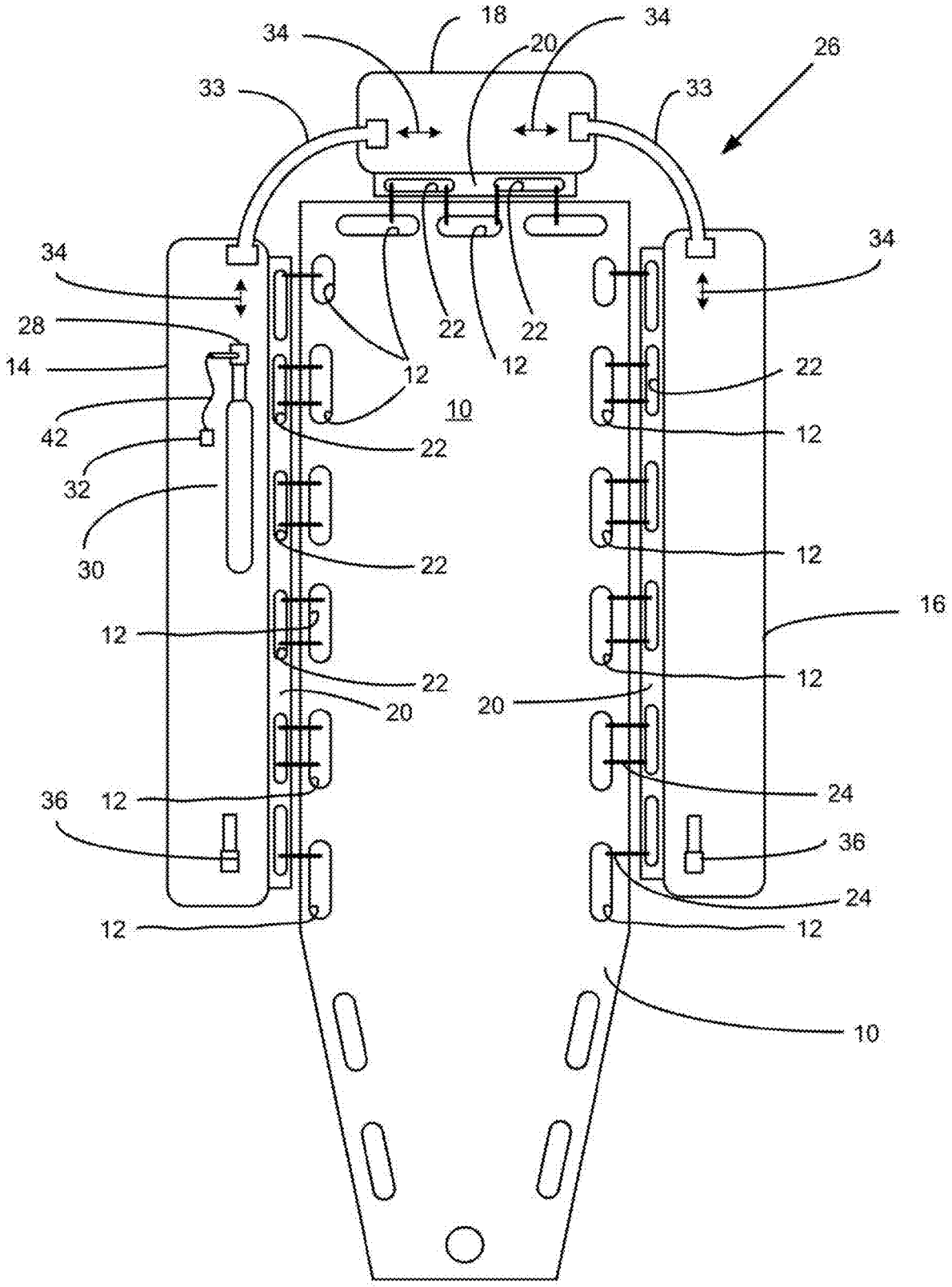
FIG. 2 is a schematic plan view of an inflatable backboard attachment attached to the backboard of FIG. 1.
Figure 3:
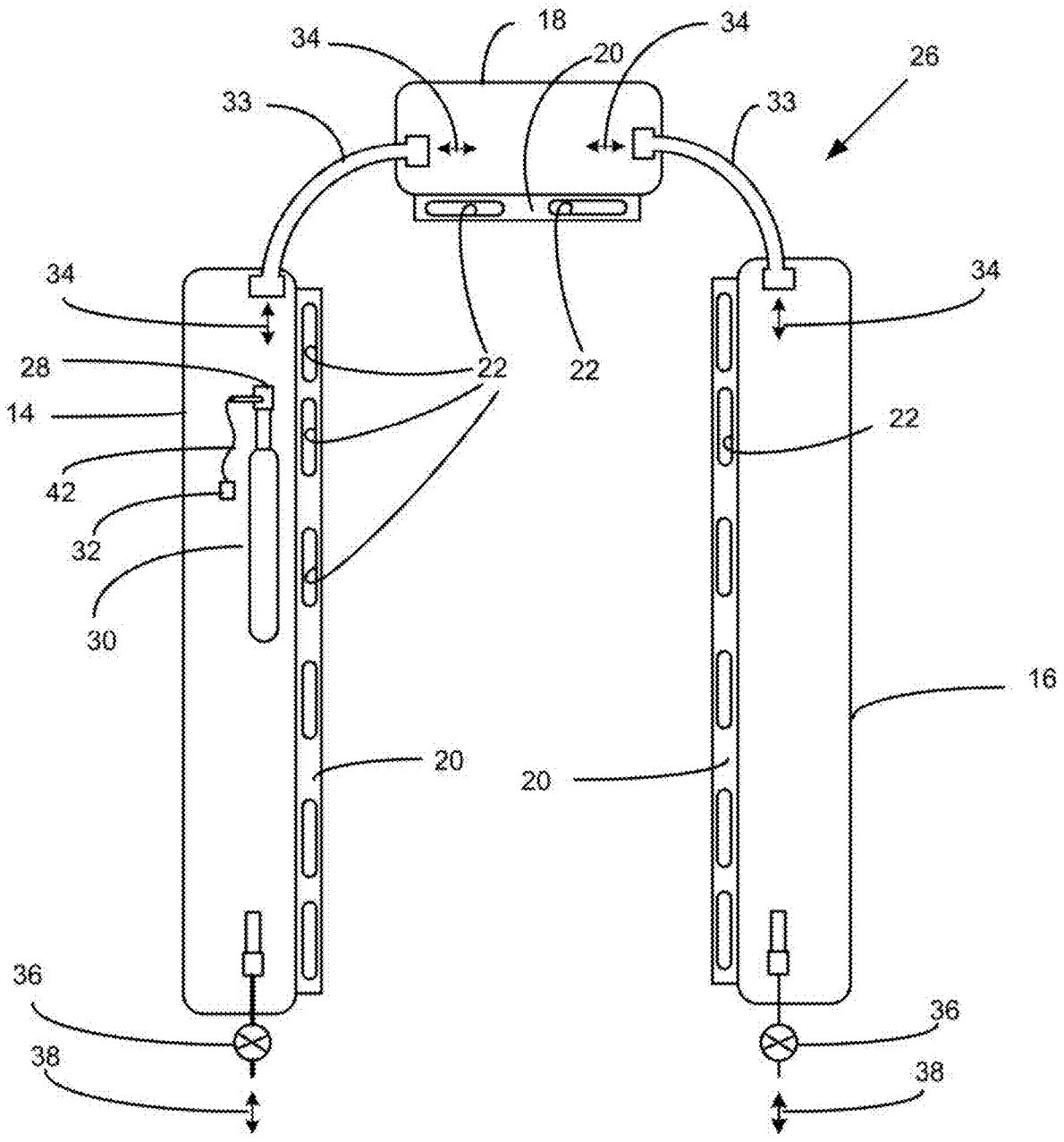
FIG. 3 is a schematic plan view of the inflatable backboard attachment of FIG. 2, with the backboard removed.

As illustrated in FIGS. 2 and 3, an inflatable bladder attachment 26 is provided, including a left side portion 14, a right side portion 16, and a head portion 18. In this particular embodiment, the portions 14, 16, 18 of the inflatable attachment 26 are separate portions, interconnected by tubes 33, so they are in fluid communication with each other. The left tube 33 connects the left portion 14 to the head portion 18, and the right tube 33 connects the head portion 18 to the right side portion 16. Since the tubes 33 are more flexible than the bladder portions 14, 16, 18, they allow the inflatable attachment 26 to flex in order to adapt to a wide range of backboards 10. Alternatively, the inflatable attachment 26 could be made as a single piece. Also, alternatively, the inflatable attachment 26 could be extended from what is shown here in order to wrap further around the rescue backboard 10, even to the point of forming a closed loop that surrounds the entire perimeter of the rescue backboard 10. So, it is understood that the inflatable attachment 26 is at least U-shaped, so it can extend around the head portion and at least part of the side portions of the rescue backboard 10, but it also could be extended beyond the basic U-shape.

The bladder portions 14, 16, 18 are manufactured from an airtight material, such as a Thermoplastic Polyurethane (TPU) with properties which include elasticity and resistance to oil, grease and abrasion. The thermoplastic polyurethane preferably is RF (Radio Frequency) welded to form the bladder portions 14, 16, 18. It is available in various colors, such as a bright yellow, to make it more easily visible when floating at a distance. Of course, other suitable materials could be used instead of TPU, if desired.

Each of the bladder portions 14, 16, 18 is flat when deflated and has an oval, nearly circular cross-sectional shape when inflated. Each of the bladder portions 14, 16, 18 has an inner margin 20, which is an extension of the welded perimeter. The inner margin 20 remains flat (does not get inflated) and defines a plurality of through openings 22 which are used for connecting the bladder portions 14, 16, 18 to the backboard 10. In this embodiment, as best shown in FIG. 2, UV stabilized nylon zip ties 24 are used to form closed loops, with each loop extending through one of the through openings 22 on the inflatable attachment 26 and through one of the through openings 12 on the backboard 10 to secure the inflatable attachment 26 to the perimeter of the backboard 10 along the head end and the left and right sides of the backboard 10. Other types of closed loop connectors could be used instead of the zip ties, such as straps (which may include hook and loop fasteners, buckles, snaps, or other fasteners or which may simply be tied to form the closed loop) threaded links, ropes, and so forth.

The left bladder portion 14 includes a threaded fitting 28, which includes a manually-operated valve, which can be opened by a rescuer by pulling on the tab 32 and/or cord 42. A small canister 30 of inflation fluid is threaded onto the fitting 28, and remains with the inflatable attachment 26 during storage and normal operation, so, when a rescuer wants to quickly inflate the inflatable attachment 26, the rescuer pulls on the tab 32 and/or cord 42 to open the valve, allowing the inflation fluid in the canister 30 to inflate the bladder portions 14, 16, 18 very rapidly. Of course, the fitting 28 may be installed in any desired location on the inflatable attachment 26. The two-way arrows 34 in FIG. 2 indicate that fluid flows freely between the bladder portions 14, 16, 18 so all the portions are at the same pressure.

The left and right bladder portions 14, 16 also include manual inflation/deflation valves 36 (See FIG. 3). These spring-loaded, manual inflation valves 36 allow the rescuer to blow additional air in (using a manual air pump or the rescuer's lungs, for instance) or to allow air to escape in the opposite direction, as depicted by the two-way arrows 38. There also may be a pressure relief valve (not shown) in the area of one of the manual inflation/deflation valves 36 or in some other desired area.

The inflatable rescue attachment 26 may be provided as a kit which can be readily secured, via the aforementioned zip ties, straps, links, or other closed loops, for instance, to a rigid backboard 10. During normal storage, the inflatable attachment 26 is in its deflated configuration, such that it stores very compactly as the three bladder portions 14, 16, 18 (or the single bladder if that option is elected) present a flat, essentially two-dimensional aspect.

In the event of an emergency, a rescuer grabs the backboard 10 with attached inflatable attachment 26 and races to the water toward the rescuee. With the attachment 26 deflated, the rescue backboard 10 behaves very much like a prior art rescue backboard 10, in that it offers practically no added resistance to forward motion in the water. Once the rescuer reaches the rescuee, he slides the rescue backboard 10 under the rescuee. Again, the deflated condition of the inflatable attachment 26 means that the backboard 10 with the attachment 26 provides no more added resistance to being submerged under the rescuee than would a prior art rescue backboard 10. Once the rescue backboard 10 is suitably placed under the rescuee, the rescuer pulls on the tab 32, which pulls the cord 42 to open the valve and admit inflation fluid from the canister 30 into all three bladder portions 14, 16, 18, quickly inflating the attachment 26 to lift the rescuee up, with his head above the water, providing a clear path to establish an airway to the rescuee as well as a hard surface for the rescuer to provide first aid, including CPR, to the rescuee. Of course, the rescuee will likely be secured with a standard harness or straps, not shown, to the rescue backboard 10. It should be noted that, instead of the canister 30, another inflation fluid source, such as a lightweight, battery-operated compressor could be used.

The rescue backboard 10 with the inflated rescue attachment 26, is towed back to shore, with the rescuee supported on the backboard 10. Once on shore, the rescuee may be transported, still on the backboard 10, to a more convenient location to administer any further aid, if needed. The inflation fluid may be released from the inflatable attachment 26 through one or both of the valves 36 at any time, as needed. For instance, if the rescuee is riding too high in the water, the rescuer may release some of the inflation fluid via the valves 36 until the desired pressure level in the three bladder portions 14, 16, 18 is reached. Also, once on land, all the inflation fluid may be released to facilitate transporting the rescuee without the impediment of the inflated rescue attachment 26. The rescue attachment 26 also may be removed from one backboard and installed for re-use on another backboard, if desired.

Figure 4:
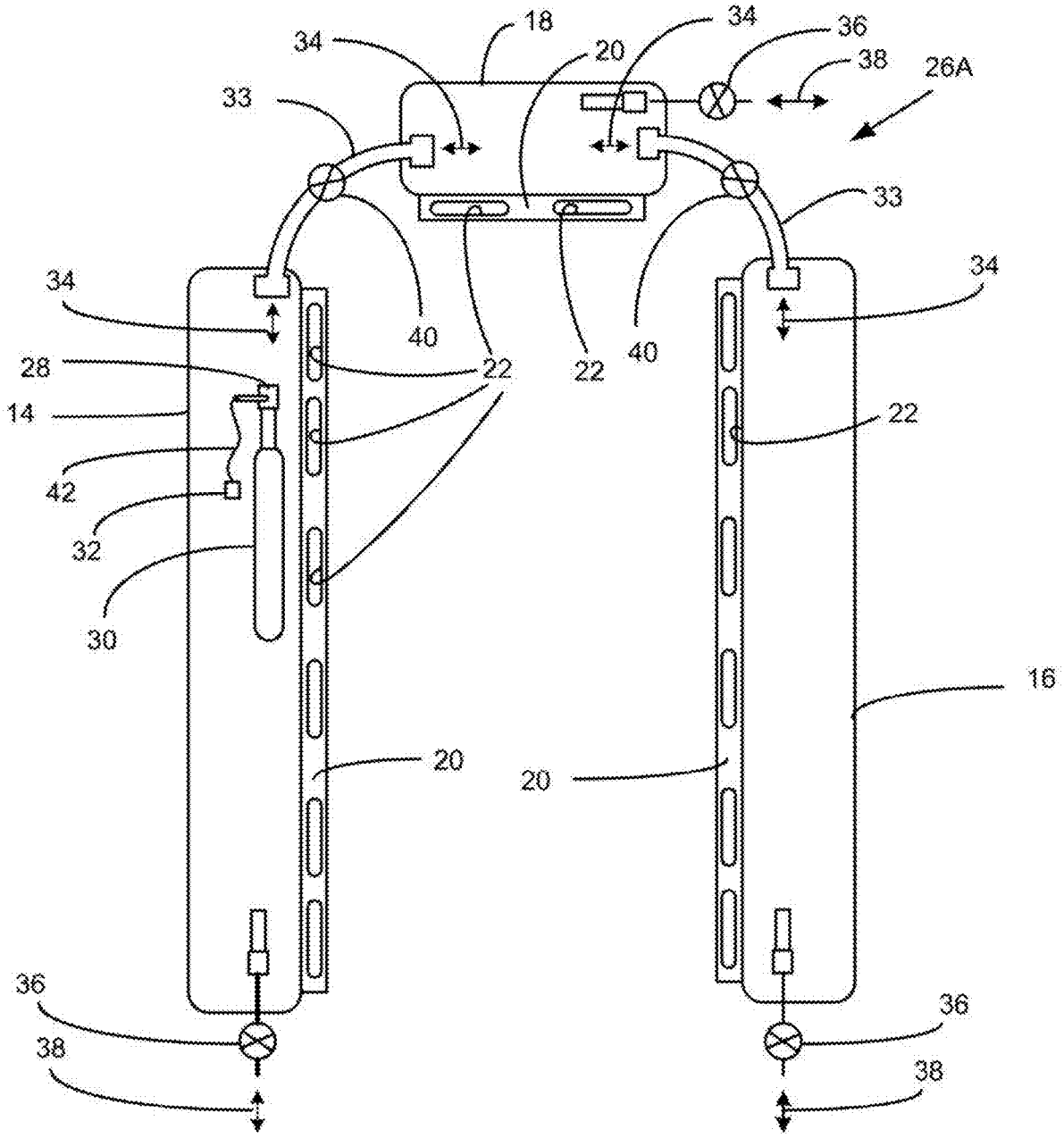
FIG. 4 is a schematic plan view of an alternative embodiment of an inflatable backboard attachment.

The embodiment of FIG. 4 is very similar to FIG. 3, but it includes isolation valves 40 so that each of the three bladder portions 14, 16, 18 may be isolated from the other portions to selectively inflate or deflate each portion without affecting the remaining portions. For the initial inflation, the isolation valves 40 normally would be open, but, during the rescue, the rescuer may want to have the head portion 18 at a higher pressure than the left and right side portions 14, 16, in order to keep the head of the rescuee at a higher elevation in the water. In this instance, the rescuer would first inflate all three bladder portions 14, 16, 18 at once, using the inflation fluid source 30. The rescuer then would close off the isolation valves 40 so that the bladder portions 14, 16, 18 are no longer in fluid communication with each other. The rescuer then may release some of the inflation fluid in the left and right side portions 14, 16 via their respective valves 36, leaving the head portion 18 at a higher pressure. Conversely, the head portion 18 may be deflated or manually inflated to a different pressure than the two side portions 14, 16, via its own valve 36.

Figure 5:
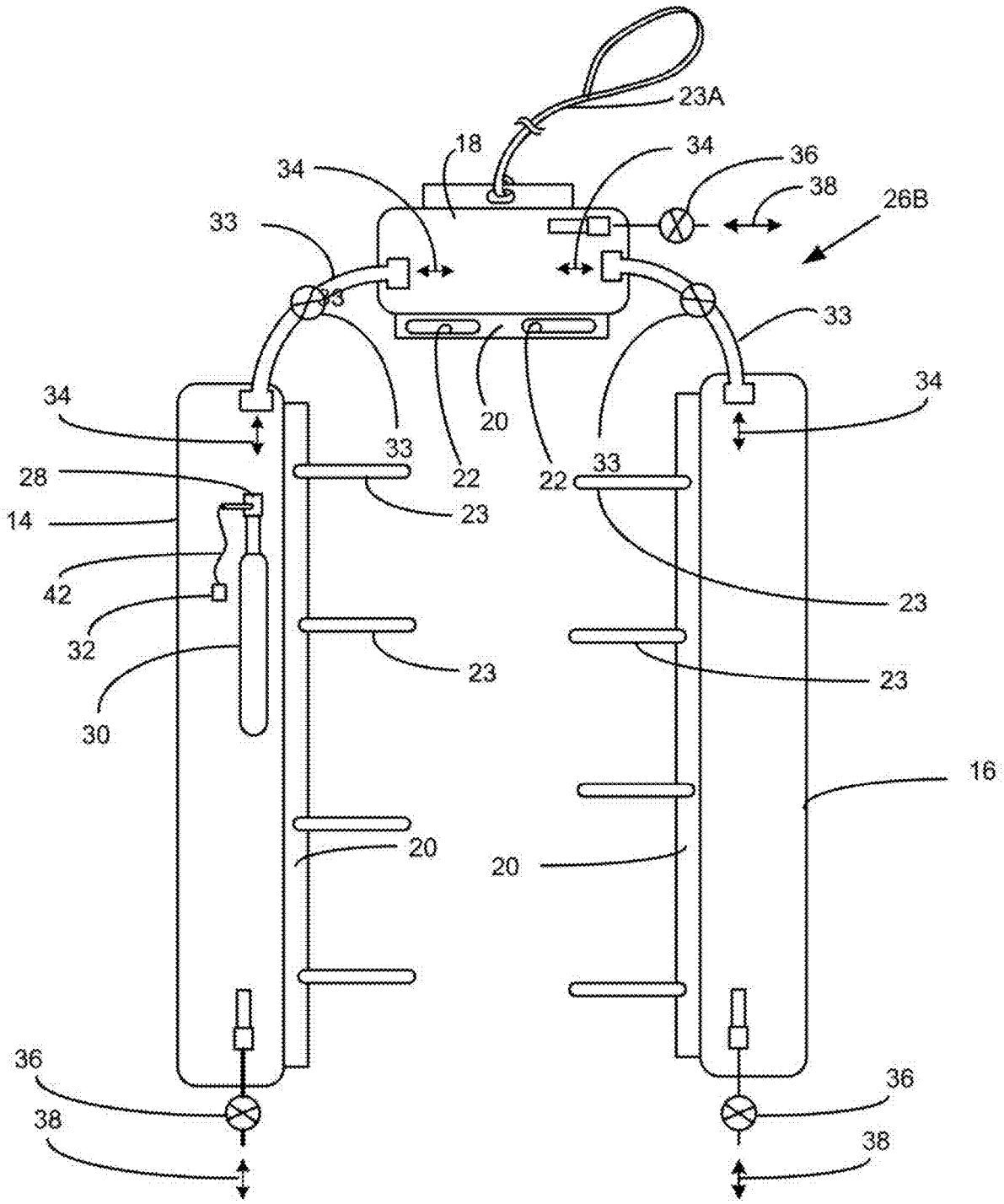
FIG. 5 is a schematic plan view of another alternative embodiment of an inflatable backboard attachment.

FIG. 5 shows another alternative embodiment of a rescue attachment 26B, in which straps 23 are sewn onto the inner margins 20 of the left and right side portions 14, 16. These straps 23 will be extended through respective openings 12 in the backboard 10 and will be looped back onto themselves, such as through a buckle, to form closed loops that secure the inflatable rescue attachment 26B to the backboard 10. The embodiment of FIG. 5 also has a tow rope 23A secured to the outer margin of the head portion 18 by extending through an opening in the outer margin. A rescuer may use the tow rope 23A to tow the rescue attachment 26B out to the person to be rescued or to tow the rescue attachment 26B back to shore with the person secured on the backboard attached to the rescue attachment. The tow rope 23A preferably is a loop that can be placed over the shoulder of the rescuer. That feature may be added to any of the embodiments.

Figure 6:
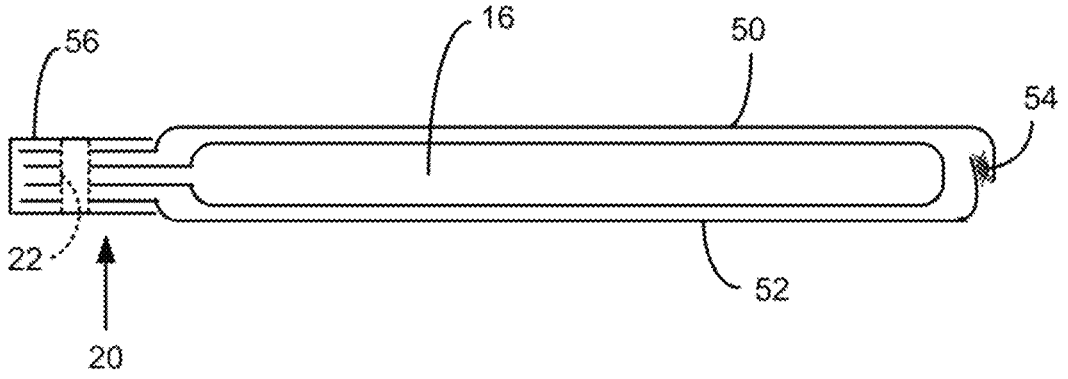
FIG. 6 is a schematic section view through another alternative embodiment of an inflatable backboard attachment.

FIG. 6 is a section view through the deflated right bladder portion 16 of FIG. 4, with a covering envelope added. The envelope includes a top layer 50 of TPU that covers the full top of the deflated right bladder portion 16, and a bottom layer 52 of TPU that covers the full bottom of the deflated right bladder portion 16. At the inner margin 20, the top layer 50, bottom layer 52, and a reinforcing layer 56 of TPU are RF welded to the inner margin 20 of the bladder 16. The openings 22 extend through all these layers. At the outer margin, there is mating hook and loop fastener 54 on the top layer 50 and on the bottom layer 52 to secure the top and bottom layers 50, 52 together in order to form an envelope around the deflated bladder 16 for storage. This protects the bladder portion 16 when it is not in use. When the right bladder portion 16 is inflated, it pushes the hook and loop fasteners apart and bursts out of the envelope formed by the top and bottom layers 50, 52. The layers 50, 52 remain secured to the inner margin 20, and, when the bladder portion 16 is deflated again, the top and bottom layers 50, 52 are secured together again along the full length of the bladder portion 16 by means of the hook and loop fastener 54. This envelope arrangement may be used on any of the bladder portions 14, 16, 18 in any of the embodiments, with the upper and lower layers 50, 52 being fixed to the respective bladder portion along the respective inner margin 22 and being releasably secured to each other along the outer margin to envelope the respective deflated bladder portion. The envelope arrangement preferably is used on all the bladder portions in all the embodiments.

Figure 7:
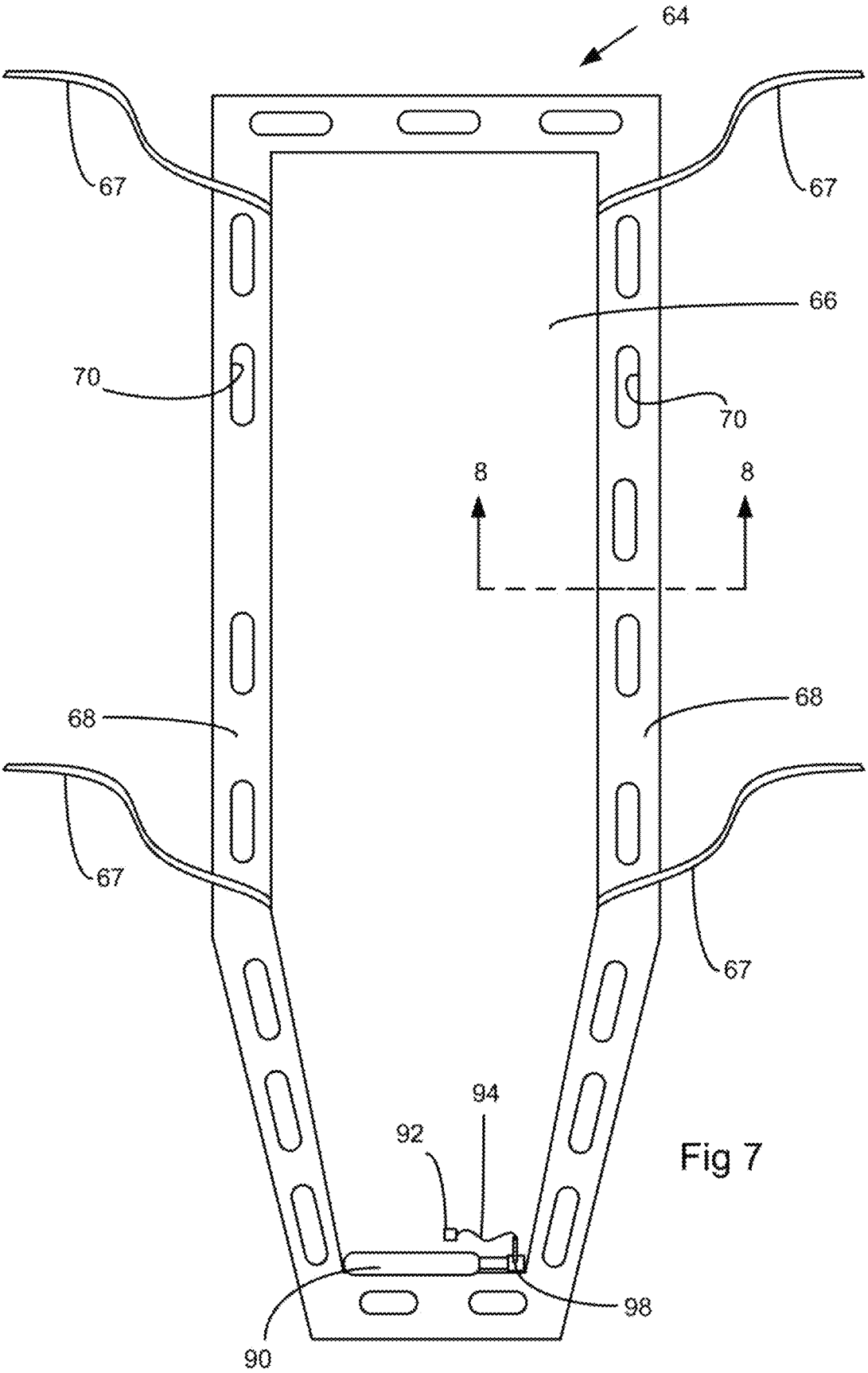
FIG. 7 is a plan view of a rigid backboard, which itself is inflatable.
Figure 8:
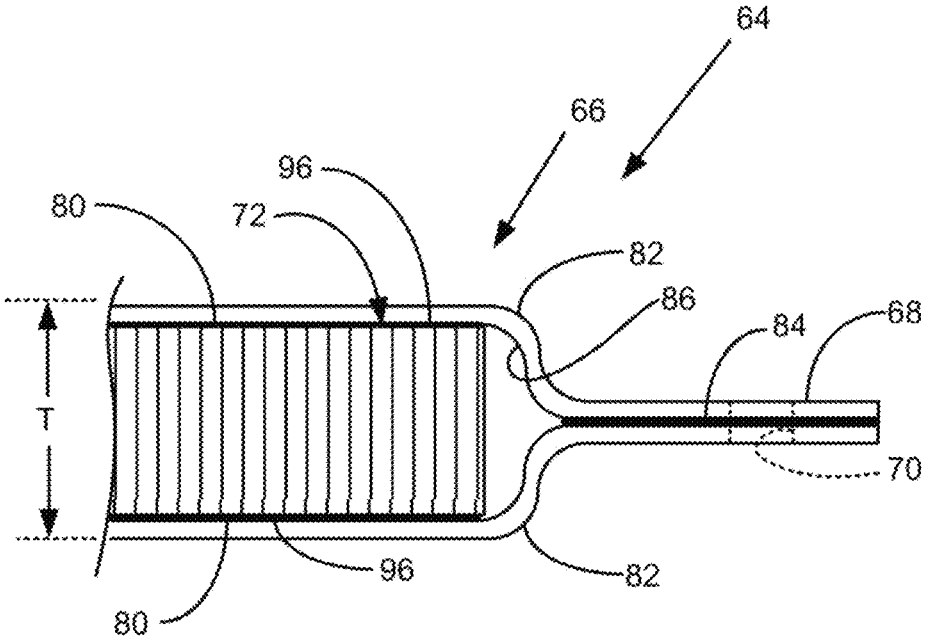
FIG. 8 is a section view taken along the section 8-8 of FIG. 7.

FIG. 7 shows a rigid inflatable backboard 64, which may be used in place of the prior art rigid backboard 10. The rigid inflatable backboard 64 includes a central portion 66 with substantially the same footprint as the prior art backboard 10 of FIG. 1. (Other suitable shapes, such as oval, rectangle, and others could be used, as long as they will support the head, torso, and legs of a human lying down on his/her back on the backboard 64.) As described later, this central portion 66 is made out of a drop stitch material which may be inflated with relatively low air pressure to obtain a flat, rigid, platform. The inflated central portion 66 is surrounded by a flange 68 extending around its entire perimeter. The flange 68 is not inflated, as can be seen in FIG. 8, and it defines a plurality of through openings 70, some of which are sized to serve as handles, which the rescuer(s) may use to grasp the rigid inflated backboard 64 to lift and transport the rescuee who is lying on (and strapped onto) the central portion 66 of the backboard 64. Alternatively, handles may be formed by straps sewn into or otherwise secured at both ends to the flange 68.

As shown in FIG. 7, straps 67 are sewn to the flange 68 adjacent to the central portion 66 of the backboard 64 and may be extended across the rescuee and secured onto the opposite side of the backboard 64 to secure the rescuee on the central portion 66. Also, a canister 90 of compressed gas is mounted on the backboard 64, in fluid communication with the interior of the central portion 66 of the backboard 64 through a fitting 98, which includes a valve. A string 94 and tab 92 extend from the fitting 98, and, when the tab 92 is pulled, it causes the string to open the valve, allowing the gas from the canister to enter into the interior of the central portion 66 to inflate the central portion 66 very rapidly.

Of course, the fitting 98 may be installed in any desired location. However, installation of the fitting 98 and canister 90 at the foot of the central portion 66 allows the manually actuated inflation device to be in an out-of-the-way location where it is not likely to harm the rescuee and where it does not interfere with the grasping of the backboard 64 by the rescuer(s) or with the access to the rescuee for the purpose of providing first aid, such as chest compressions. Typically, the recommended pressure inside the central portion 66 to obtain a flat, rigid surface is on the order of 5 PSIG (pounds per square inch).

When the central portion 66 is inflated, it has a substantially uniform thickness "T" (See FIG. 8), which is substantially the same dimension as the thickness "t" (See FIG. 1A) of the prior art rigid backboard 10.

Figure 9:
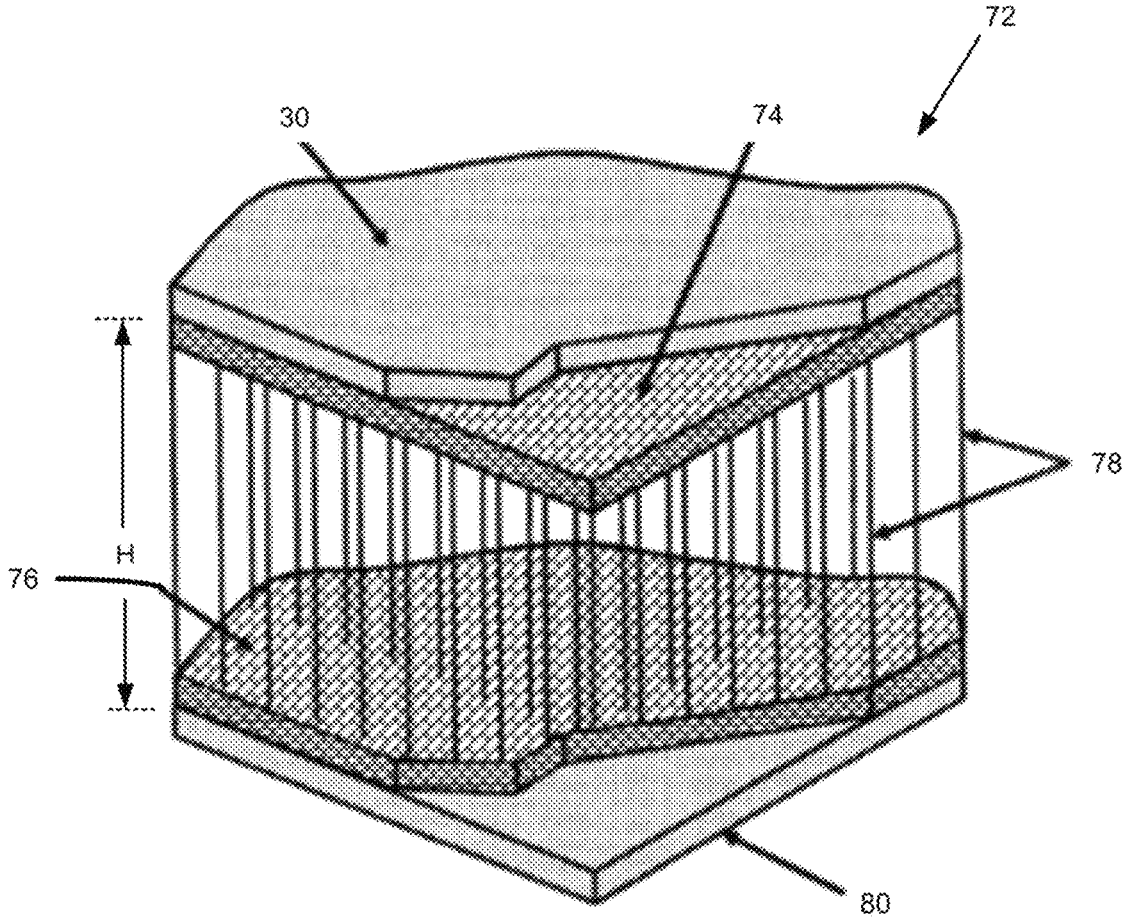
FIG. 9 is a broken-away, section view of the drop stitch material used in the inflatable rigid backboard of FIG. 7.

As described above, the central portion 66 is made from a drop stitch material 72, shown in detail in FIG. 9. The drop stitch material 72 is made from upper and lower woven fabric layers 74, 66, with a plurality of drop stitch fibers 78 woven into and extending between the upper and lower woven fabric layers 74, 76. There are many drop stitch fibers 78 extending from every square inch of the surface of the woven fabric layers 74, 76. In this embodiment, the drop stitch fibers 78 are of equal length H. The fabric layers 74, 76 are made of a material such as PVC. Since the drop stitch fibers 78 maintain a fixed spacing between the fabric layers along the whole area of the fabric layers, they do not allow the central portion 66 to bulge out in one place when it is compressed in another place. This makes the central portion 66 rigid when it is inflated. The pile height H is slightly less than the thickness "T" of the inflated central portion 66 of the backboard 64.

As shown in FIG. 8, upper and lower outer layers or skins 80 are bonded to the outer surface of the upper and lower fabric layers 74, 76. In this embodiment, these outer layers 80 are made of sheets of non-woven PVC material.

As shown in FIG. 8, top and bottom enclosure sheets 82 of Thermoplastic Polyurethane material (TPU) enclose and are bonded to the outer layers 80 of the drop stitch material 72 and extend beyond the drop stitch material 72 to form the surrounding flange 68. The top and bottom enclosure sheets 82 of TPU material are Radio Frequency (RF) welded together along a weld 84 that extends around the entire perimeter of the drop stitch material 72 to form the flange 78 and to form an airtight chamber 36 within which the drop stitch material 72 resides. The flange 68 defines the through openings 70 (See also FIG. 10) for grasping, lifting, and transporting the backboard 64. As may be appreciated in FIG. 8, this flange 68 is not inflated and is much more flexible than the inflated central portion 66.

While it may be possible in the future to manufacture the drop stitch material 72 such that the outer layers 80 of the drop stitch material 72 extend beyond the drop stitches 78 and beyond the woven layers 74, 76 and can be bonded together to form the flange 68 and the enclosure 86 (serving as enclosure layers), that has not been done in this embodiment. Instead, the additional enclosure layers 82 have been added to form the enclosure 86 and the flange 68.

Looking again at FIG. 8, it can be seen that, as part of the manufacturing process, a bonding tape 96, such as a Bemis™ bonding tape, is used as an interface between the outer layers 80 of the drop stitch material 72 and the enclosure sheets 82. The bonding tape 96 bonds to both of these sheet materials 80, 82. After inserting and adhering the bonding tape 96 between the respective outer sheet 80 and enclosure sheet 82 on both the top and bottom of the drop stitch material 72, RF welding is used to weld the sheets 82, 80 and bonding tape 96 together. The RF process melts the tape 96 and welds the respective enclosure sheet 82 and outer sheet 80 together to adhere the outer sheet 80 of the drop stitch material 72 to the respective enclosure sheet 82. In this particular embodiment, the enclosure sheets 82 made of TPU have a much longer shelf life than the PVC outer sheet 80 of the drop stitch material 72, and it does not degrade with UV light. This means that the inflatable backboard 64 can be stored out in the light or can be deflated, rolled up or folded, and stored away for a long period of time and still be ready to use when needed.

The theory behind the drop stitch material 72 inside the enclosure 86 is that, once the gas has inflated the central portion 66 of the inflatable backboard 64 to the point where the drop stitching fibers 78 are fully extended and they have reached the pile height "H", there is no further volume available for the air to go.

In a typical balloon (like the prior art inflatable rescue devices), if you press in on one side, the balloon expands out at another side, resulting in a squishy consistency. However, the drop stitches 78 prevent the balloon from bulging out anywhere, so the balloon resists compression where you are pushing on it, because the compressed air has nowhere else to go. The compressed air thus is confined and cannot find another area to bulge out of this confined volume, so the central portion 66 retains its shape as a flat, rigid inflatable backboard. In fact, instead of acting like a balloon, the inflated central portion 66 acts like a rigid, prior art backboard, having the same rigidity as a prior art rescue backboard made of wood, fiberglass or hard plastic, which provides rigid support for a rescuee to protect the spine and to permit the rescuer to do chest compressions on the rescuee.

Figure 10:
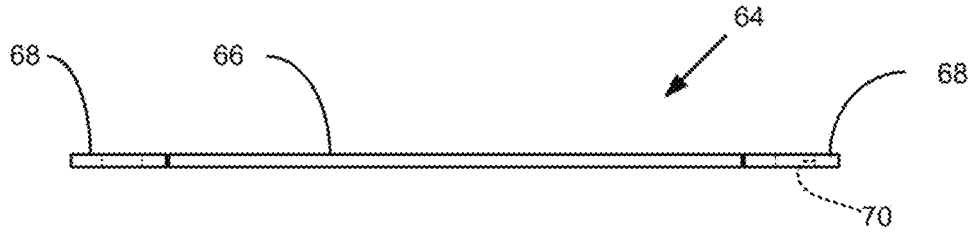
FIG. 10 is a section view of the inflatable backboard of FIG. 7 when in its deflated state.

The central portion 66 of the backboard 64 may be deflated by removing the canister 90 and allowing the gas to escape. In its deflated configuration, as shown in FIG. 10, the backboard 64 is very thin, essentially two-dimensional, and completely flexible. It may be rolled up or folded for transportation and storage. In this particular configuration, the deflated backboard 64 may be rolled up along the longitudinal axis of the canister 90 and around the canister 90 so that the canister 90 is encircled and protected by the rolled up, deflated backboard 64. This provides the best protection for the canister 90 against accidental actuation as the inflatable backboard 64 is being transported or otherwise moved.

Alternatively, the deflated backboard 64 may be rolled up starting at the head end, and rolling toward the foot end, of the backboard 64 such that the canister 90 is visible and accessible once the backboard 64 is rolled up. This provides instant visibility of the canister 40 so the rescuer can check the canister 90 to ensure that one is present before taking the backboard 64 out to the field. It also provides instant access to the pull tab 92 to release the compressed gas into the central portion 66 of the backboard 64, allowing for the action of the compressed gas to assist the user in unrolling the backboard 64 as it is inflated. Various other rolling or folding arrangements could be used.

In the event of an emergency, a rescuer grabs the rigid inflatable backboard 64 while in its deflated configuration and races to the rescuee. In its deflated condition, the backboard 64 takes up very little space so that one rescuer can easily carry more than a single backboard 64. The deflated backboard 64 also is small and flexible so it can be taken through tight areas. Once inflated, the backboard 64 behaves very much like a prior art rescue backboard 10 in that it offers a flat, rigid surface for the rescuee to be strapped down and transported.

Once the backboard 64 is at the site and ready to be put to use, the user pulls on the tab 92 which pulls the cord 94 to admit compressed gas from the canister 90 into the central portion 66 of the backboard 64, quickly inflating the backboard 64, providing a flat, rigid surface for the user to transport the rescuee as well as to provide first aid, such as CPR, to the rescuee. The rescuee is secured with a harness (not shown) or straps 67, to the backboard 64.

It also should be noted that the inflated backboard 64 floats, which makes it easy to use in water rescues. It may be placed under the rescuee before being inflated, which helps elevate the rescuee to the surface of the water in a water rescue.

While the examples described above use PVC and TPU materials, it will be obvious that other desired materials could be used instead.

Figure 11:
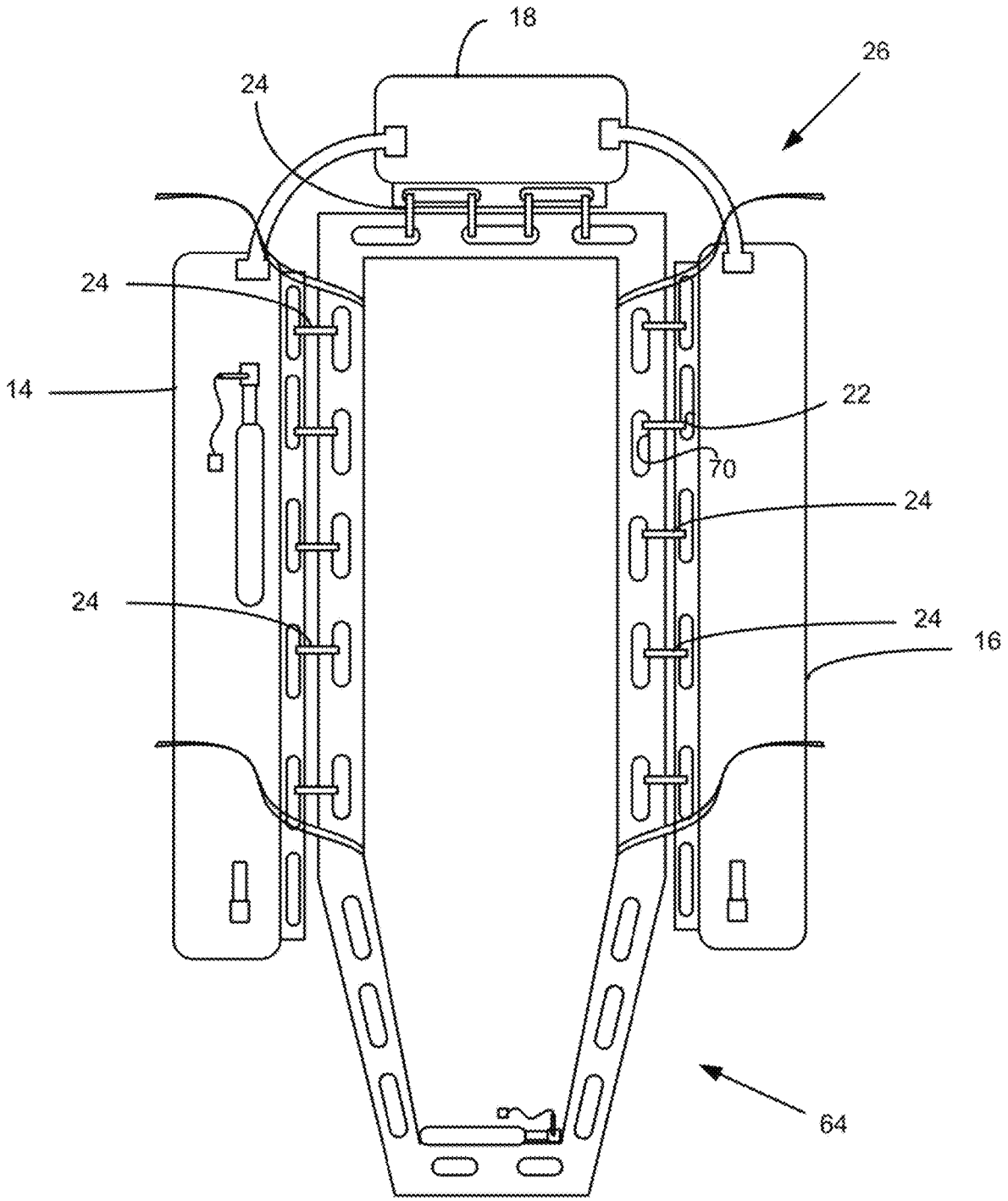
FIG. 11 shows the rigid backboard of FIG. 7 with the inflatable backboard attachment of FIG. 3 mounted onto it.

FIG. 11 shows the rigid inflatable backboard 64 being used together with the inflatable rescue attachment 26 of FIG. 3. The rigid inflatable backboard 64 may be used with any of the inflatable rescue attachments 26, 26A, or 26B of FIGS. 1-6 instead of using a standard backboard 10. In that case, both the rigid inflatable backboard 64 and the inflatable rescue attachment may be transported in compact form and then inflated at the remote site where the rescue takes place.

It will be obvious to those skilled in the art that various modifications may be made to the embodiments described above without departing from the scope of the present invention as claimed.

What is claimed is:

1. An inflatable attachment fora rescue backboard, comprising:

at least a U-shaped, inflatable bladder, defining a head portion and left and right side portions adapted to lie just outside corresponding portions of a rescue backboard;

an inner margin on said inflatable bladder which projects inwardly from said head portion and said left and right side portions of said inflatable bladder;

a plurality of connector arrangements for connecting the inner margin along the head portion and said left and right side portions to the corresponding portions of the rescue backboard;

an inflation fluid source mounted on said inflatable bladder and in fluid communication with said inflatable bladder through a valve, wherein opening said valve provides fluid communication between said inflation fluid source and said head portion and said left and right side portions of said inflatable bladder to inflate said inflatable bladder; and wherein said left and right portions and said head portion of said inflatable bladder are separate bladders spaced away from each other, and further comprising a left tube interconnecting said left side portion to said head portion;

and a right tube interconnecting said right side portion to said head portion.

2. An inflatable attachment for a rescue backboard as recited in claim 1, wherein said left and right tubes are more flexible than said bladder portions, providing flexibility between the left side bladder portion, right side bladder portion and head bladder portion to permit the attachment to adapt to a wide range of backboard shapes.

3. An inflatable attachment for a rescue backboard as recited in claim 2, wherein said connector arrangements include said inner margin defining a plurality of slots adapted to lie adjacent to corresponding slots in the rescue backboard.

4. An inflatable attachment for a rescue backboard as recited in claim 3, wherein said connector arrangements further comprise a plurality of closed loops, each of said closed loops extending through one of said slots.

5. An inflatable attachment for a rescue backboard as recited in claim 3, and further comprising a top cover layer lying on top of said head portion and said left and right side portions of said bladder and secured along said inner margin; a bottom cover layer lying beneath said head portion and said left and right side portions of said bladder and secured along said inner margin; wherein said top and bottom cover layers include mating strips of hook and loop fastener along an outer margin, such that, when said bladder is deflated, said mating strips are secured together along said outer margin to form an envelope around said bladder, and when said bladder is inflated, it pushes the hook and loop fasteners apart and bursts out of said envelope, and wherein said slots defined on said inner margin extend through said top and bottom cover layers.

6. An inflatable attachment for a rescue backboard as recited in claim 2, wherein said connector attachments include straps secured to said inner margin.

7. An inflatable attachment for a rescue backboard as recited in claim 2, and further comprising a rescue backboard, wherein said inflatable bladder is secured to said rescue backboard with the left side and right side portions and the head portion secured to the corresponding portions of said rescue backboard.

8. An inflatable attachment for a rescue backboard as recited in claim 7, wherein said bladder is secured to said rescue backboard using closed loops that extend through openings in said rescue backboard.

9. An inflatable attachment fora rescue backboard as recited in claim 8, and further comprising a top cover layer lying on top of said head portion and said left and right side portions of said bladder and secured along said inner margin; a bottom cover layer lying beneath said head portion and said left and right side portions of said bladder and secured along said inner margin; wherein said top and bottom cover layers include mating strips of hook and loop fastener along an outer margin, such that, when said U-shaped bladder is deflated, said mating strips are secured together along said outer margin to form an envelope around said bladder, and when said bladder is inflated, it pushes the hook and loop fasteners apart and bursts out of said envelope.

10. An inflatable attachment for a rescue backboard as recited in claim 2, and further comprising a first isolation valve between said left side portion and said head portion and a second isolation valve between said head portion and said right side portion, and a manual release valve in each of said left and right side portions.

11. An inflatable attachment for a rescue backboard as recited in claim 10, and further comprising a rescue backboard, wherein said bladder is secured to said rescue backboard with the left side and right side portions and the head portion secured to the corresponding portions of said rescue backboard.

12. An inflatable attachment fora rescue backboard as recited in claim 2, and further comprising a top cover layer lying on top of said head portion and said left and right side portions of said bladder and secured along said inner margin; a bottom cover layer lying beneath said head portion and said left and right side portions of said bladder and secured along said inner margin; wherein said top and bottom cover layers include mating strips of hook and loop fastener along an outer margin, such that, when said bladder portions are deflated, said mating strips are secured together along said outer margin to form an envelope around said bladder portions, and when said bladder portions are inflated, they push the hook and loop fasteners apart and burst out of said envelope.

13. An inflatable attachment for a rescue backboard as recited in claim 1, and further comprising a first isolation valve between said left side portion and said head portion and a second isolation valve between said head portion and said right side portion and a manual release valve in each of said left and right side portions.

14. An inflatable attachment for a rescue backboard as recited in claim 1, and further comprising a top cover layer lying on top of said head portion and said left and right side portions of said bladder and secured along said inner margin; a bottom cover layer lying beneath said head portion and said left and right side portions of said bladder and secured along said inner margin; wherein said top and bottom cover layers include mating strips of hook and loop fastener along an outer margin, such that, when said bladder is deflated, said mating strips are secured together along said outer margin to form an envelope around said bladder, and when said bladder is inflated, it pushes the hook and loop fasteners apart and bursts out of said envelope.

* * * * *